US009570056B2

(12) United States Patent
Kiyoshige

(10) Patent No.: US 9,570,056 B2
(45) Date of Patent: Feb. 14, 2017

(54) AUDIO DATA SYNTHESIS METHOD, AUDIO OUTPUT METHOD, AND PROGRAM FOR SYNTHESIZING AUDIO DATA BASED ON A TIME DIFFERENCE

(71) Applicant: OLYMPUS CORPORATION, Tokyo (JP)

(72) Inventor: Ryuichi Kiyoshige, Tokyo (JP)

(73) Assignee: OLYMPUS CORPORATION, Tokyo (JP)

( * ) Notice: Subject to any disclaimer, the term of this patent is extended or adjusted under 35 U.S.C. 154(b) by 167 days.

(21) Appl. No.: 14/498,821

(22) Filed: Sep. 26, 2014

(65) Prior Publication Data

US 2015/0112686 A1 Apr. 23, 2015

(30) Foreign Application Priority Data

Oct. 21, 2013 (JP) ..... 2013-218487

(51) Int. Cl.
*G10H 1/00* (2006.01)

(52) U.S. Cl.
CPC ..... *G10H 1/0083* (2013.01); *G10H 2240/325* (2013.01)

(58) Field of Classification Search
CPC ..... G10H 2240/325
USPC ..... 704/256, 258
See application file for complete search history.

(56) References Cited

FOREIGN PATENT DOCUMENTS

JP 2004-193868 A 7/2004

*Primary Examiner* — Susan McFadden
(74) *Attorney, Agent, or Firm* — Westerman, Hattori, Daniels & Adrian, LLP

(57) ABSTRACT

An audio data synthesis method including a time of a plurality of audio data is adjusted without using a device which can acquire the standard time. Specifically, audio data is obtained based on synchronized recording of the first and second recorders without using standard time. A time difference is calculated between an own terminal and another terminal, based on the time at which output of a first sound from the audio output module is started, a time at which input of a sound corresponding to the audio data to the audio input module is started, a time indicated by the first information, and a time indicated by the second information. Second and third audio data is synthesized after a time difference between the second and third audio data based on the third sound which is input to the audio input module is adjusted, based on the time difference.

8 Claims, 10 Drawing Sheets

AUDIO DATA SYNTHESIS METHOD, AUDIO OUTPUT METHOD, AND PROGRAM FOR SYNTHESIZING AUDIO DATA BASED ON A TIME DIFFERENCE

BACKGROUND OF THE INVENTION

Field of the Invention

The present invention relates to a technology of synthesizing a plurality of pieces of audio data.

Priority is claimed on Japanese Patent Application No. 2013-218487, filed on Oct. 21, 2013, the content of which is incorporated herein by reference.

Description of Related Art

IC recorders which record audio information for preparing the minutes of interviews and meetings have been known. The IC recorders include microphones, and are capable of recording the audio information as digital audio data. The audio data recorded by the IC recorders can be reproduced by electronic devices such as personal computers.

Meanwhile, the IC recorders have been used in a variety of applications such as recording of sounds generated in nature, for example, sounds of wind and waterfalls, and chirp of insects, recording of engine sounds played in motor sports, air shows, and the like, and recording of music sounds generated in concerts and by musical instruments being practiced, as well as in business applications. When the IC recorders are mainly used for hobbies as described above, high-quality recording capable of achieving sound localization, that is, a sensation of three-dimensional spatial sounds is desired.

In the above case, it is preferable to perform stereo recording. In the stereo recording, recording is performed in a state in which two microphones are installed while being apart by a suitable distance. However, there are many cases of troublesome treatment such as handling of microphone cables. If a wireless connection is used instead of using the cables, there is no need to handle and install the cables, but it is difficult to synchronize two microphones.

Japanese Unexamined Patent Application, First Publication No. 2004-193868 discloses a synchronization method of audio data which is transmitted from a transmission device to a plurality of output devices. In this method, the times of respective devices are synchronized with a reference time, and a time at which audio data is output from the output devices is determined, based on a time at which the transmission device makes a request of timestamps to the output devices and a time at which the transmission device receives responses from the output devices.

SUMMARY OF THE INVENTION

An audio data synthesis terminal according to a first aspect of the present invention includes: a recording module which records a recorded audio data including a first audio data; an audio output module which outputs a first sound based on the recorded audio data; an audio input module to which a second sound that is output from another terminal and a third sound that is output from a sound source excluding the another terminal is input; an audio detection unit which detects an audio data which matches the first audio data, from an input audio data based on the second sound which is input to the audio input module; a wireless communication module which receives first information indicating a time at which input of the first sound is started in the another terminal and second information indicating a time at which output of the second sound is started in the another terminal, and which receives a second audio data based on a sound which is output from the sound source and input to the another terminal, from the another terminal; a time difference calculation unit which calculates a time difference between own terminal and the another terminal, based on the time at which output of the first sound from the audio output module is started, a time at which input of a sound corresponding to the audio data to the audio input module is started, a time indicated by the first information, and a time indicated by the second information; and a data synthesis unit which synthesizes the second audio data and third audio data after a time difference between the second audio data and the third audio data based on the third sound which is input to the audio input module is adjusted, based on the time difference.

In a second aspect of the present invention, according to the first aspect, the audio output module may output the first sound based on the first audio data.

In a third aspect of the present invention, according to the second aspect, the wireless communication module may further transmit third information indicating the first audio data to the another terminal.

An audio data recording terminal according to a fourth aspect of the present invention includes: a recording module which records a recorded audio data including a first audio data; an audio output module which outputs a first sound based on the recorded audio data; an audio input module to which a second sound that is output from another terminal and a third sound that is output from a sound source excluding the another terminal is input; an audio detection unit which detects an audio data which matches the first audio data, from an input audio data based on the second sound; a control unit which causes the first sound based on the recorded audio data to output from the audio output module, when the audio data is detected; and a wireless communication module which transmits first information indicating a time at which input of the second sound is started in the audio input module, and second information indicating a time at which output of the first sound is started from the audio output module, to the another terminal, and transmits a second audio data based on the third sound which is output from the sound source and input to the audio input module, to the another terminal.

In a fifth aspect of the present invention, according to the fourth aspect, the audio output module may output the first sound based on the first audio data.

In a sixth aspect of the present invention, according to the fifth aspect, the wireless communication module may further receive third information indicating the first audio data from the another terminal, and the audio output module may output a sound based on the first audio data indicated by the third information.

An audio data synthesis system according to a seventh aspect of the present invention includes an audio data synthesis terminal and an audio data recording terminal, the audio data synthesis terminal includes a first recording module which records a first recorded audio data including a first audio data; a first audio output module which outputs a first sound based on the first recorded audio data; a first audio input module to which a second sound that is output from the audio data recording terminal and a third sound that is output from a sound source excluding the audio data recording terminal is input; a first audio detection unit which detects an audio data which matches the first audio data, from a first input audio data based on the second sound; a first wireless communication module which receives first information indicating a time at which input of the first sound is started in the audio data recording terminal and second information indicating a time at which output of the second sound is started in the audio data recording terminal, and receives a second audio data based on a sound which is input to the audio data recording terminal, from the audio data recording terminal; a time difference calculation unit which calculates a time difference between the audio data synthesis terminal and the audio data recording terminal, based on the time at which output of the first sound from the first audio output module is started, a time at which input of a sound corresponding to the audio data to the first audio input module is started, a time indicated by the first information, and a time indicated by the second information; and a data synthesis unit which synthesizes the second audio data and third audio data after a time difference between the second audio data and the third audio data based on the third sound which is input to the first audio input module is adjusted, based on the time difference calculated. The audio data recording terminal includes a second recording module which records a second recorded audio data including fourth audio data; a second audio output module which outputs a fourth sound based on the second recorded audio data; a second audio input module to which a fifth sound that is output from the audio data synthesis terminal and a sixth sound that is output from the sound source is output; a second audio detection unit which detects an audio data which matches the fourth audio data, from a second input audio data based on the fifth sound which is input to the second audio input module; a control unit which causes the second audio output module to output the fourth sound, when the audio data is detected; and a second wireless communication module which transmits first information indicating a time at which input of the fifth sound is started in the second audio input module, and second information indicating a time at which output of the fourth sound is started, to the audio data synthesis terminal, and transmits the second audio data based on the sixth sound which is input to the second audio input module, to the audio data synthesis terminal.

Further, an audio data synthesis method according to an eighth aspect of the present invention causes includes: causing an audio output module to output a first sound based on a recorded audio data which is recorded in a recording module that records the recorded audio data including first audio data; causing an audio input module to input a second sound which is output from another terminal; causing an audio detection unit to detect an audio data which matches the first audio data, from an input audio data based on a third sound which is output from the another terminal and input to the audio input module; causing a wireless communication module to receive first information indicating a time at which input of the first sound is started in the another terminal, and second information indicating a time at which output of the second sound is started in the another terminal; causing a time difference calculation unit to calculate a time difference between own terminal and the another terminal, based on the time at which output of the first sound from the audio output module is started, a time at which input of a sound corresponding to the audio data to the audio input module is started, a time indicated by the first information, and a time indicated by the second information; causing the audio input module to input a fourth sound which is output from a sound source excluding the another terminal; causing the wireless communication module to receive second audio data based on the fourth sound which is input to the another terminal, from the another terminal; and causing a data synthesis unit to synthesize the second audio data and third audio data after a time difference between the second audio data and the third audio data based on the fourth sound which is input to the audio input module is adjusted, based on the calculated time difference.

Further, an audio output method according to a ninth aspect of the present invention, includes: causing an audio input module to input a first sound which is output from another terminal; causing an audio detection unit to detect an audio data which matches a first audio data recorded in a recording module that records a recorded audio data including first audio data, from input audio data based on the first sound which is output from the another terminal and input to the audio input module; causing an audio output module to output a second sound based on the recorded audio data when the audio data is detected; causing a wireless communication module to transmit first information indicating a time at which input of the first sound is started in the audio input module, and second information indicating a time at which output of the second sound from the audio output module is started, to the another terminal; causing the audio input module to input a third sound which is output from a sound source excluding the another terminal; and causing the wireless communication module to transmit a second audio data based on the third sound which is input to the audio input module, to the another terminal.

A computer-readable device storing a program according to a tenth aspect of the present invention that causes a computer to perform the steps of: causing an audio output module to output a first sound based on a recorded audio data which is recorded in a recording module that records the recorded audio data including first audio data; causing an audio input module to input a second sound which is output from another terminal; detecting an audio data which matches the first audio data, from an input audio data based on the second sound which is input to the audio input module; causing a wireless communication module to receive first information indicating a time at which input of the first sound is started in the another terminal, and second information indicating a time at which output of the second sound is started in the another terminal; calculating a time difference between own terminal and the another terminal, based on a time at which output of the first sound from the audio output module is started, a time at which input of a sound corresponding to the audio data to the audio input module is started, a time indicated by the first information, and a time indicated by the second information; causing the audio input module to input a third sound which is output from a sound source excluding the another terminal; causing the wireless communication module to receive second audio data based on the third sound which is input to the another terminal, from the another terminal; and synthesizing the second audio data and third audio data, after a time difference between the second audio data and the third audio data based on the third sound which is input to the audio input module is adjusted, based on the calculated time difference.

A computer-readable device storing a program according to an eleventh aspect of the present invention that causes a computer to perform the steps of: causing an audio input module to input a first sound which is output from another terminal; detecting an audio data which matches a first audio data recorded in a recording module that records a recorded audio data including the first audio data, from an input audio data based on the first sound which is input to the audio input module; causing an audio output module to output a second sound based on the recorded audio data when the audio data is detected; causing a wireless communication module to transmit first information indicating a time at which input of the first sound is started in the audio input module, and second information indicating a time at which output of the second sound from the audio output module is started, to the another terminal; causing the audio input module to input a third sound which is output from a sound source excluding the another terminal; and causing the wireless communication module to transmit a second audio data based on the third sound which is input to the audio input module, to the another terminal.

DETAILED DESCRIPTION OF THE INVENTION

Hereinafter, an embodiment of the present invention will be described with reference to the drawings.

Overview

Figure 1:
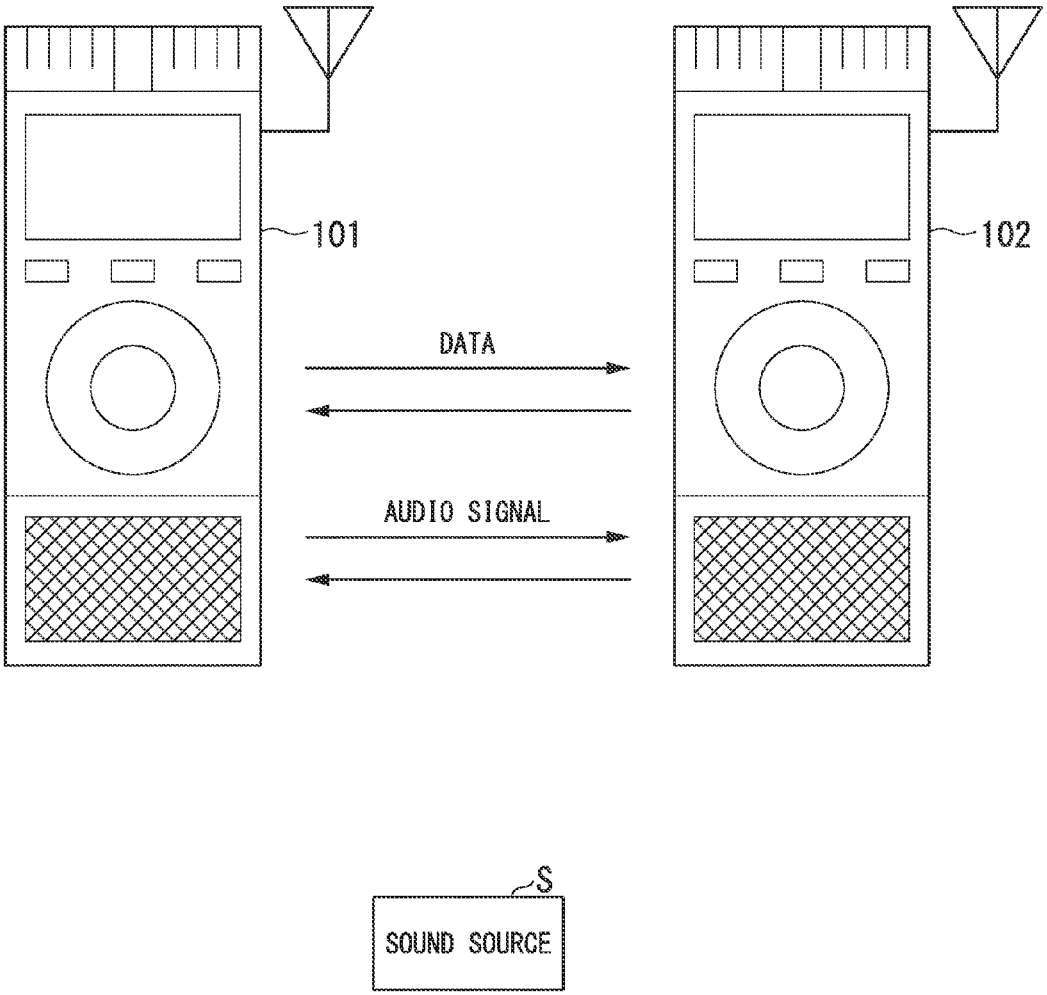
FIG. 1 is a block diagram illustrating a configuration of an audio data synthesis system according to an embodiment of the present invention.

FIG. 1 shows a configuration of an audio data synthesis system according to an embodiment of the present invention. The audio data synthesis system includes recorders 101 and 102 that record audio generated from sound sources S. The recorders 101 and 102 have a function of recording sound generated in meetings and music events, and by playing musical instruments, and a communication function.

The audio to be recorded may include human voices or sounds of various musical instruments. Alternatively, the sound to be recorded may include sounds that are generated in nature such as the sound of wind or water and the cries of animals or insects, and sounds which are artificially generated from engines of vehicles, aircrafts, or the like and sounds of sirens or speakers. In other words, the sound to be recorded is any one of voices or sounds listed above, or a combination of a plurality of sounds. Further, the audio data to be dealt with by the recorders 101 and 102 may be data which is generated by converting analog audio signals based on raw sound into digital signals, or may be data which is digitally generated based on information for designating scales, sound intensities, tempos, or the like. The sound sources S are humans, musical instruments, wind, water, animals, insects, engines, sirens, speakers, or the like.

The recorders 101 and 102 form a network by the communication function. In FIG. 1, when the sound source S is, for example, a musical instrument, for stereo recording of sounds generated by playing the musical instruments, it is assumed that the recorders 101 and 102 are respectively assigned to a left channel and a right channel and are used as stereo microphones.

The recorders 101 and 102 respectively record sounds generated from the same sound source S. The audio data recorded in one recorder out of the recorders 101 and 102 is finally transmitted to the other recorder, and two pieces of audio data are synthesized into one piece of audio data.

The recorders 101 and 102 respectively generate independent clocks, and thus a difference occurs in times to be recorded in the audio data. Therefore, if respective pieces of audio data recorded in the recorders 101 and 102 are simply synthesized, there is a shift in play times, and thus it is difficult to obtain a proper sound localization. In order to solve this problem, the recorders 101 and 102 according to the present embodiment transfer digital data and analog sound using the communication function, an audio output function, and an audio input function, and thus a time difference between the recorders 101 and 102 is obtained. A method of obtaining the time difference will be described later.

System Configuration

Figure 2:
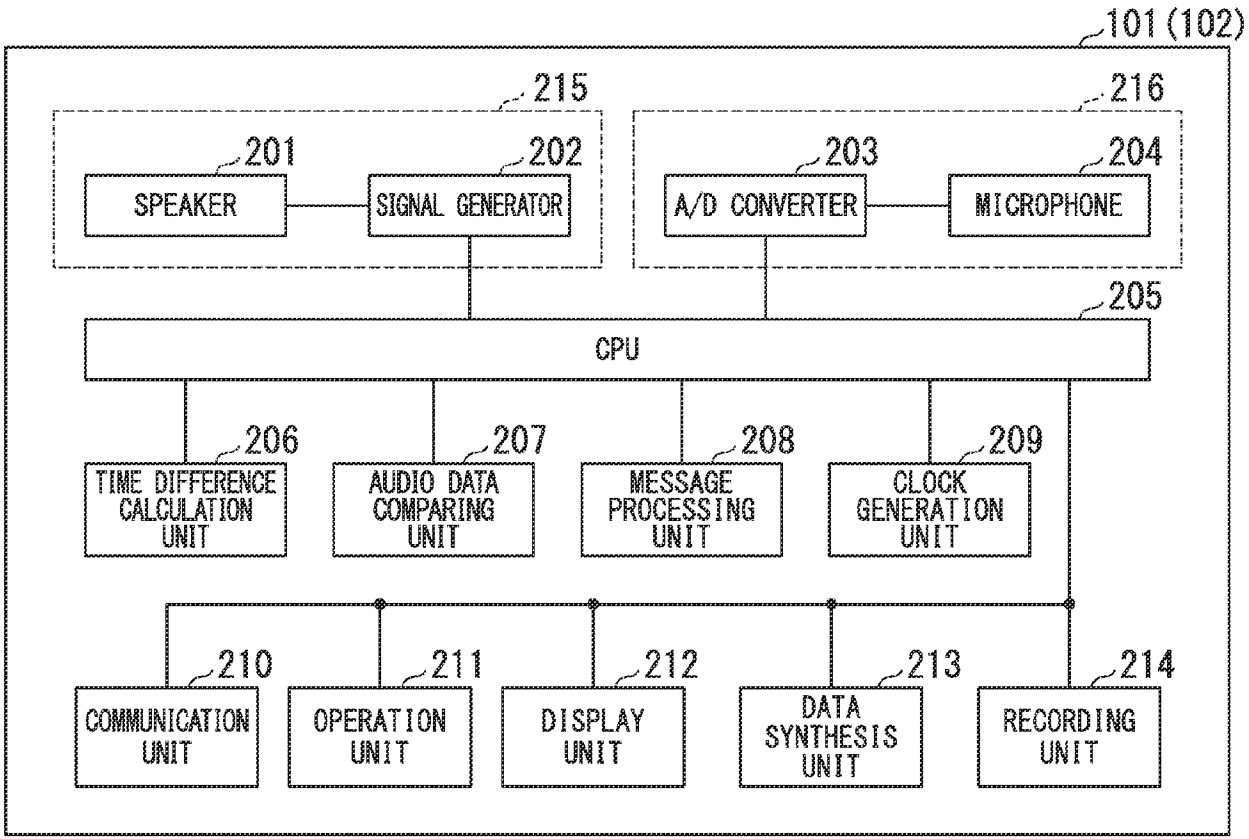
FIG. 2 is a block diagram illustrating a configuration of a recorder according to the embodiment of the present invention.

FIG. 2 shows an example of the configurations of the recorders 101 and 102 according to the present embodiment. As an example, the recorders 101 and 102 have the same configuration. Each of the recorders 101 and 102 includes a speaker 201, a signal generator 202, an A/D converter 203, a microphone 204, a CPU 205, a time difference calculation unit 206, an audio data comparing unit 207, a message processing unit 208, a clock generation unit 209, a communication unit 210, an operation unit 211, a display unit 212, a data synthesis unit 213, and a recording unit 214.

The speaker 201 converts an analog audio signal into sound, and outputs the sound. The signal generator 202 generates an analog audio signal based on digital audio data, and outputs the analog audio signal to the speaker 201. The speaker 201 and the signal generator 202 constitute an audio output module 215 (audio output device) that outputs sound (first sound) based on the audio data recorded in the recording unit 214.

The microphone 204 converts the input sound into an analog audio signal. The A/D converter 203 converts the analog audio signal, which is converted in the microphone 204, into digital audio data. The microphone 204 and the A/D converter 203 constitute an audio input module 216 (audio input device) that inputs the sound (second sound) which is output from another terminal (recorder 101 or recorder 102) and the sound (third sound) which is output from a sound source S other than the another terminal.

The CPU 205 controls respective units inside the recorders 101 and 102. The clock generation unit 209 generates clocks and counts time (system time) inside the recorders 101 and 102.

The time counted by the clock generation unit 209 is acquired by the CPU 205. The message processing unit 208 generates a message transmitted through the communication unit 210. Further, the message processing unit 208 processes the message received through the communication unit 210.

The audio data comparing unit 207 compares the digital audio data, converted by the A/D converter 203, with the audio data recorded in the recording unit 214. Thus, the audio data comparing unit 207 detects the audio data which matches the audio data recorded in the recording unit 214, from the audio data based on the sound which is input to the audio input module 216. The time difference calculation unit 206 calculates a difference in system times (time difference) of its own terminal and the another terminal, based on time information obtained from the clock generation unit 209 and time information acquired through the communication unit 210.

The communication unit 210 is a wireless communication module (wireless communication device) that performs wireless communication with the another terminal that constitutes a wireless communication network such as a wireless Local Area Network (LAN).

Specifically, the communication unit 210 performs transmission and reception of a message required for calculating a time difference, in a wireless manner. Further, the communication unit 210 transmits audio data recorded in its own terminal to the another terminal in a wireless manner. Alternatively, the communication unit 210 receives the audio data which is recorded in the another terminal and transmitted from the another terminal in a wireless manner.

The operation unit 211 (operation module, operation device) receives an operation that the user performs.

The display unit 212 (display module, display device) displays a menu that prompts the user to perform an input, a processed result, and the like. The data synthesis unit 213 synthesizes the audio data recorded in the recording unit 214 and the audio data received from the another terminal so as to generate one piece of audio data.

The recording unit 214 is a recording module (a recording device, a storage unit, a storage module, and a storage device) that records (stores) data or information such as audio data in which a specific audio pattern unique to a terminal is recorded, audio data based on the sound which is input to the audio input module 216, and audio data synthesized by the data synthesis unit 213. The recording unit 214 may be either a non-volatile recording medium or a volatile recording medium. The audio data in which a specific audio pattern unique to a terminal is recorded may be either data generated by converting the analog audio signal which is generated from the raw sound into digital data or data which is digitally generated based on information for designating a scale, a sound intensity, a tempo, or the like.

In the example described below, the recorder 101 synthesizes the audio data recorded in both the recorders 101 and 102. In the example, the recorder 101 corresponds to an audio data synthesis terminal according to an aspect of the present invention, and the recorder 102 corresponds to an audio data recording terminal according to an aspect of the present invention. The operation unit 211 and the display unit 212 are not components essential for the audio data synthesis terminal. Further, the time difference calculation unit 206, the operation unit 211, the display unit 212, and the data synthesis unit 213 are not components essential for the audio data recording terminal.

The recording unit 214 may record a program for controlling the operation of the CPU 205 and necessary data. In addition, the functions of the time difference calculation unit 206, the audio data comparing unit 207, the message processing unit 208, and the data synthesis unit 213 may be realized by the CPU 205. The functions of the time difference calculation unit 206, the audio data comparing unit 207, the message processing unit 208, and the data synthesis unit 213 can be realized as software functions by the CPU 205 reading and executing, for example, a program for controlling the operations. In addition, the program may be provided by "a computer readable recording medium" such as a flash memory. The program described above may be input to the recorders 101 and 102 by being transmitted to the recorders 101 and 102 from a computer that stores the program in a storage device or the like through a transmission medium, or by transmission waves in the transmission medium. Here, the "transmission medium" that transmits a program is a medium having a function of transmitting information, such as a network (communication network) such as the Internet or a communication line such as a telephone line. Further, the program described above may realize a part of the above functions. Furthermore, the program described above may be a so-called differential file (differential program) which can be realized in combination with programs which have already been recorded in the computer.

Operation Sequence

Figure 3:
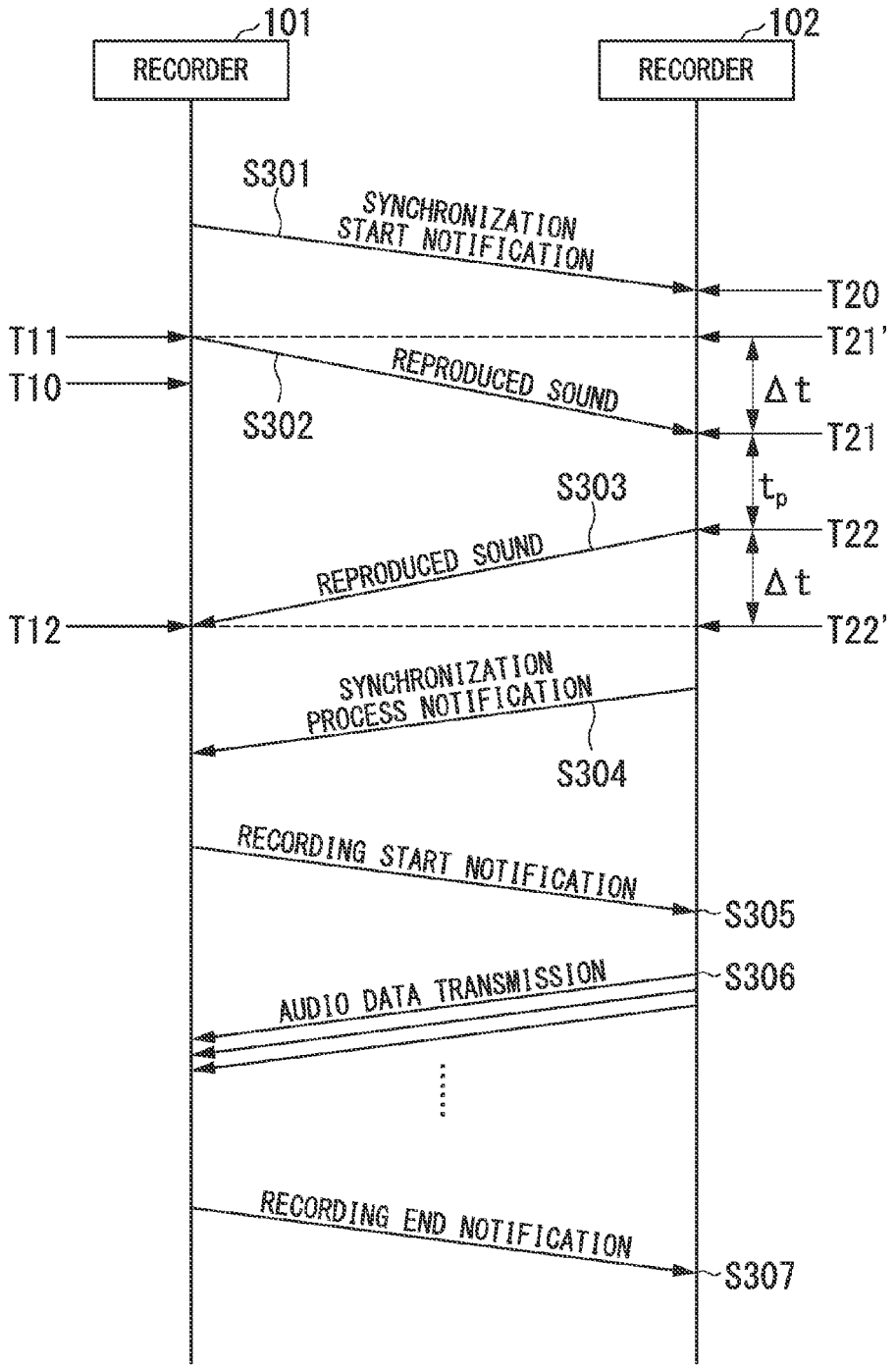
FIG. 3 is a sequence diagram illustrating an operation of the audio data synthesis system according to the embodiment of the present invention.

FIG. 3 shows an operation sequence for the calculation of the time difference and the recording between the recorders 101 and 102 constituting a wireless communication network. First, in the recorder 101, the communication unit 210 transmits a synchronization start notification to the recorder 102 (step S301). The synchronization start notification is a message that notifies the start of a process for time synchronization. The synchronization start notification includes audio data indicating a specific audio pattern unique to the terminal (recorder 101), which is recorded in the recording unit 214. In the recorder 102, when the audio data indicating the specific audio pattern unique to the terminal (recorder 101) is recorded in advance in the recording unit 214, the information included in the synchronization start notification may be information for designating the audio data.

In the recorder 102, the communication unit 210 receives the synchronization start notification transmitted from the recorder 101. If the synchronization start notification is received, the CPU 205 starts the recording and records time T20 at which the recording is started in the recording unit 214. Time T20 is a time earlier than the time at which the analog audio signal, which is output from the microphone 204 immediately after the start of the recording, is converted into the audio data by the A/D converter 203.

Subsequently, in the recorder 101, the audio output module 215 outputs the sound (reproduced sound) based on the audio data indicating the specific audio pattern unique to the terminal (recorder 101), which is recorded in the recording unit 214 (step S302). The sound is sound which is converted from the specific signal pattern unique to the terminal (recorder 101). Further, the CPU 205 records time T11, at which the output of the sound is started in the recording unit 214. Further, the CPU 205 starts the recording and records time T10 at which the recording is started in the recording unit 214. Time T10 is a time earlier than the time at which the analog audio signal, which is output from the microphone 204 immediately after the start of the recording, is converted into the audio data by the A/D converter 203.

In the recorder 102, after the recording is started at time T20, the audio input module 216 receives the sound which is output from the recorder 101. Further, the audio data comparing unit 207 detects time T21 at which input of the sound which is output from the recorder 101 is started by a method which will be described later. The detected time T21 is recorded in the recording unit 214. Further, the CPU 205 records the audio data which is output from the A/D converter 203 in the recording unit 214.

Subsequently, in the recorder 102, the audio output module 215 outputs the sound (reproduced sound) based on the audio data indicating the specific audio pattern unique to the terminal (recorder 101), which is recorded in the recording unit 214 (step S303). The sound is sound which is converted from the specific signal pattern unique to the terminal (recorder 101) included in the synchronization start notification. Further, the CPU 205 records time T22 at which the sound is output in the recording unit 214.

In the recorder 101, after the recording is started at time T10, the audio input module 216 receives the sound which is output from the recorder 102. Further, the audio data comparing unit 207 detects time T12 at which the input of the sound output from the recorder 102 is started by a method which will be described later. The detected time T12 is recorded in the recording unit 214. Further, the CPU 205 records the audio data which is output from the A/D converter 203 in the recording unit 214.

In the recorder 102, after the series of processes described above are performed, the communication unit 210 transmits a synchronization process notification to the recorder 101 (step S304). The synchronization process notification is a message that notifies information required for the process for time synchronization. The synchronization process notification includes time 121 and time 122 recorded in the recording unit 214.

In the recorder 101, the communication unit 210 receives the synchronization process notification transmitted from the recorder 102. The time difference calculation unit 206 calculates a time difference between the recorder 101 and the recorder 102, as will be described below. Here, in the recorder 102, an elapsed time between time T21 at which the sound which is output from the recorder 101 in step S302 is input and time T22 at which the sound is output in step S303 is set to $t_p$. Further, a time required for sound which is output from the recorder 101 to reach the recorder 102 is set to Δt. The time difference can be obtained in the following manner.

The following Expression (1) and Expression (2) are established between time T11 and time T12. In the Expression (1), T21' is a time in the recorder 102 at the same absolute time as T11 at which the output of the sound from the recorder 101 is started. In the Expression (1), T22' is the time in the recorder 102 at the same absolute time as the T12 at which the input of the sound to the recorder 101 is started.

$$T12-T11=T22'-T21'=t_p+\Delta t\times 2 \quad (1)$$

$$t_p=T22-T21 \quad (2)$$

The following Expression (3) is established from Expression (1) and Expression (2). Further, the following Expression (4) and Expression (5) are established. The time difference calculation unit 206 calculates Δt by Expression (3), and calculates time T21' and time T22' by Expression (4) and Expression (5).

$$\Delta t=\{(T12-T11)-(T22-T21)\}/2 \quad (3)$$

$$T21'=T21-\Delta t \quad (4)$$

$$T22'=T22+\Delta t \quad (5)$$

The obtained time difference is a difference between time T11 in the recorder 101 and time T21' in the recorder 102 or a difference between time T12 in the recorder 101 and time T22' in the recorder 102.

Accordingly, if the obtained time difference is set to ΔT, the time difference calculation unit 206 calculates ΔT by the following Expression (6) or Expression (7).

$$\Delta T=T11-T21' \quad (6)$$

$$\Delta T=T12-T22' \quad (7)$$

After the time difference is calculated, in the recorder 101, the communication unit 210 transmits a recording start notification to the recorder 102 (step S305). The recording start notification is a message that notifies the start of recording (recording of audio data). Further, the CPU 205 starts the recording.

In the recorder 102, the communication unit 210 receives the recording start notification which is transmitted from the recorder 101. The CPU 205 starts the recording based on the recording start notification.

In the recorders 101 and 102, after the recording is started, the audio input module 216 receives the sound which is output from the sound source S. The CPU 205 records the audio data which is output from the A/D converter 203 in the recording unit 214.

During the recording, in the recorder 102, the communication unit 210 transmits a message including the audio data which is sequentially recorded in the recording unit 214, to the recorder 101 (step S306).

In the recorder 101, the communication unit 210 receives a message which is transmitted from the recorder 102. The data synthesis unit 213 adjusts the time difference between the audio data received from the recorder 102 and the audio data based on the sound which is output from the sound source S and input to the audio input module 216, based on the time difference calculated by the time difference calculation unit 206, and then synthesizes the audio data.

When the recording is ended, in the recorder 101, the communication unit 210 transmits a recording end notification to the recorder 102 (step S307). The recording end notification is a message that notifies the end of the recording (recording of audio data). Further, the CPU 205 ends the recording.

In the recorder 102, the communication unit 210 receives the recording end notification transmitted from the recorder 101. The CPU 205 ends the recording based on the recording end notification.

In the example shown in the present embodiment, in step S303, the recorder 102 outputs sound based on the audio data indicating the specific audio pattern unique to the recorder 101. As another example, in step S303, the recorder 102 may output sound based on the audio data indicating the specific audio pattern unique to the recorder 102. In this case, the recorder 101 stores the audio data indicating the specific audio pattern unique to the recorder 102 in advance in the recording unit 214. In this case, the recorder 102 may transmit the same message as the synchronization start notification, which is transmitted from the recorder 101 to the recorder 102, to the recorder 101. In other words, the recorder 102 may transmit a message including the audio data indicating the specific audio pattern unique to the recorder 102 to the recorder 101.

Signal Pattern for Synchronization

Figure 4:
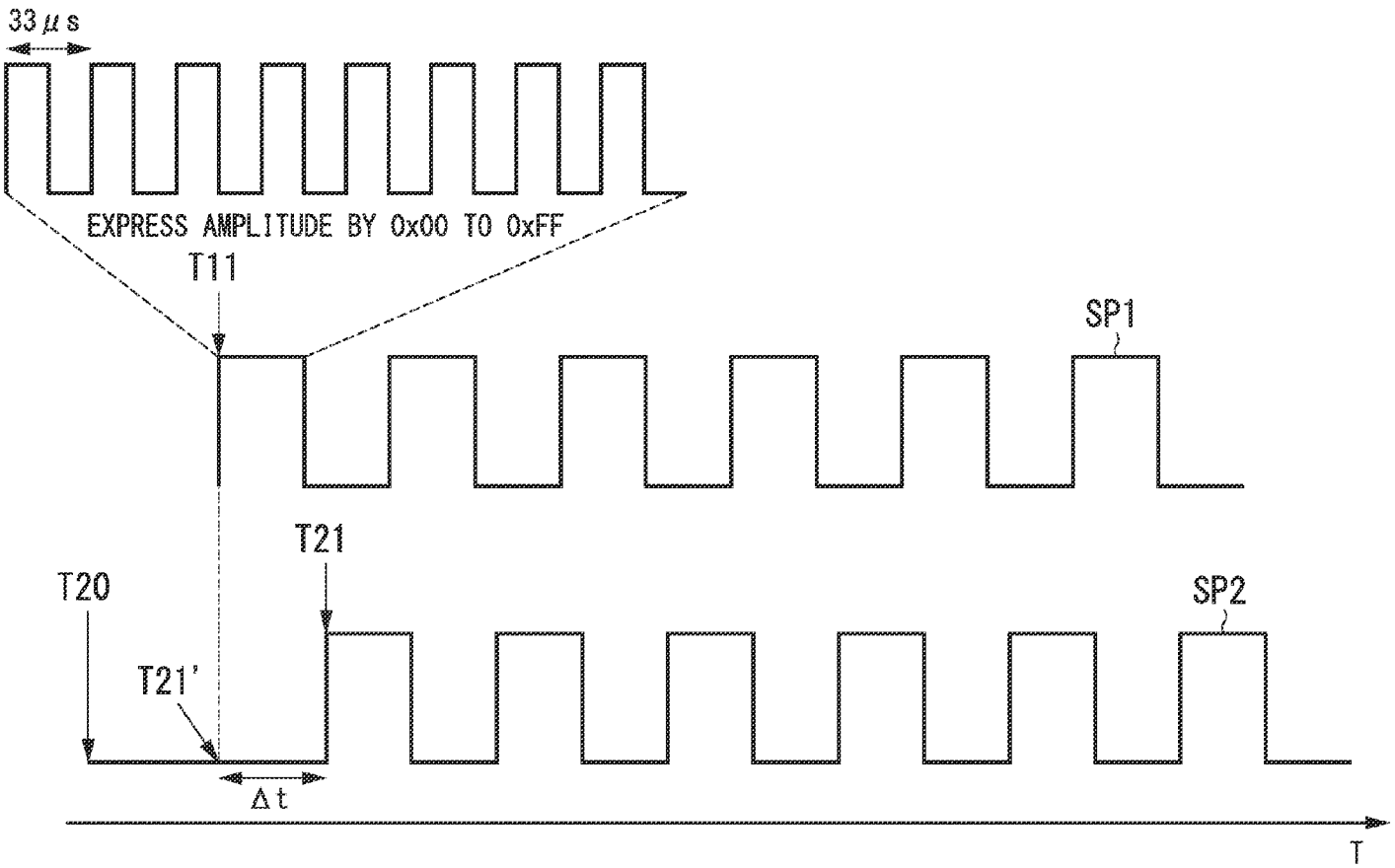
FIG. 4 is a timing chart of an audio signal pattern for synchronization in the embodiment of the present invention.

FIG. 4 shows an example of an audio signal pattern for synchronization (for example, a pattern of an analog audio signal which is output by the signal generator 202). The horizontal direction of FIG. 4 represents a time and the vertical direction of FIG. 4 represents a signal value. The audio signal pattern SP1 is an audio signal pattern that the recorder 101 generates, and the audio signal pattern SP2 is an audio signal pattern that the recorder 102 generates.

In the example shown in FIG. 4, the audio signal pattern is a square wave. In order to make the frequency of the sound which is actually generated be the frequency outside the audible range, if the frequency is, for example, 30 kHz, as shown in FIG. 4, one wavelength of the audio signal pattern is set to 33 μs. For example, a Media Access Control (MAC) address which is assigned to each terminal is used as information unique to a terminal.

It is possible to assign two values to one wavelength, by setting the audio signal pattern of one wave length, for example, as a silent state or a sound state. In the silent state, the signal value of one entire wavelength is 0. In the sound state, for example, the signal value of the first half of one wavelength is a predetermined value that is greater than 0, and the signal value of the second half of one wavelength is 0. It is possible to represent 0x00 to 0xFF in hexadecimal notation by using an audio signal pattern of eight wavelengths in which two values can be assigned to one wavelength. The audio signal pattern unique to a terminal is configured by combining six audio signal patterns each having eight wavelengths.

In the recorder 102, the audio data comparing unit 207 compares the pattern of the audio data included in the synchronization start notification which is received from the recorder 101 with the pattern of the audio data corresponding to the sound which is output from the recorder 101. Thus, the audio data comparing unit 207 determines whether or not the sound which is input to the audio input module 216 is the sound which is output form the recorder 101. The recorder 102 starts recording from time T20 at which the synchronization start notification is received. In the recorder 102, the audio data comparing unit 207 can acquire time T21 at which the sound which is output from the recorder 101 is received, by analyzing the audio data which is recorded from time T20.

For example, the audio data comparing unit 207 sequentially performs the above comparison of the audio data from time T20. The audio data comparing unit 207 performs the comparison within the range of the audio data corresponding to the pattern in which six audio signal patterns each having eight wavelengths are combined. In the range, when the pattern of the audio data included in the synchronization start notification completely matches the pattern of the audio data corresponding to the sound which is output from the recorder 101, the audio data comparing unit 207 determines that the sound which is input to the audio input module 216 is the sound which is output from the recorder 101. In this case, the audio data comparing unit 207 detects the timing at which the amplitude of the audio signal pattern first appears, as time T21.

In the same manner, in the recorder 101, the audio data comparing unit 207 compares the pattern of the audio data which is recorded in the recording unit 214 with the pattern of the audio data corresponding to the sound which is output from the recorder 102. The audio data which is recorded in the recording unit 214 is identical to the audio data included in the synchronization start notification which is transmitted to the recorder 102. Through the comparison, the audio data comparing unit 207 acquires time T12 at which the sound is output from the recorder 102.

FIG. 4 shows time T21' in the recorder 102 at the same absolute time as T11 at which the output of the sound from the recorder 101 is started, and a time Δt required for sound which is output from the recorder 101 to reach the recorder 102. The time difference calculation unit 206 calculates time T21' using the aforementioned Expression (4). Further, the time difference calculation unit 206 may calculate time T22' using the aforementioned Expression (5).

Operation of Recorder 101 During Synchronization Process

Figure 5:
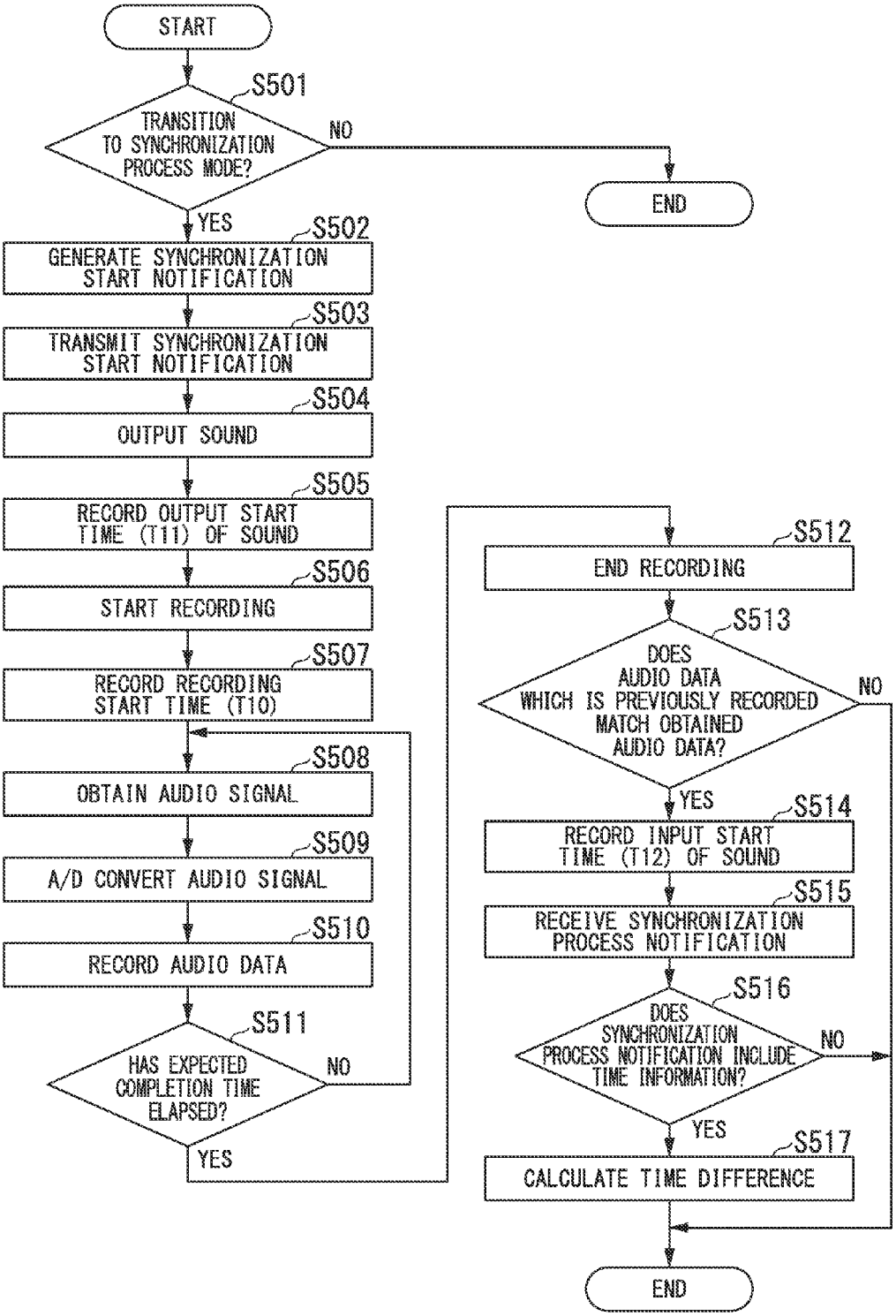
FIG. 5 is a flowchart illustrating a procedure of an operation of the recorder according to the embodiment of the present invention.

FIG. 5 shows the flow of a process of calculating a time difference by the recorder 101. When the process is started, the recorder 101 is in a state of being connected to the recorder 102 through a network. If the process is started, the CPU 205 determines whether or not the mode of the recorder 101 transitions to a synchronization process mode (step S501). If the mode of the recorder 101 does not transition to the synchronization process mode, the process is ended. Further, if the mode of the recorder 101 transitions to the synchronization process mode, the following processes will be performed.

As a condition in which the mode of the recorder 101 transitions to the synchronization process mode, for example, it is necessary that there is no trace of the synchronization process being performed when the recorder 101 and the recorder 102 are finally connected through a network. Alternatively, as the condition in which the mode of the recorder 101 transitions to the synchronization process mode, the synchronization process mode has to be selected by the user's operation. When the recorders 101 and 102 are configured to store information regarding the time difference only while they are connected through a network, it is determined that the recorder 101 does not have information regarding the time difference, and thus it can be ascertained that there is no trace of the synchronization process being performed when the recorder 101 and the recorder 102 are finally connected through the network.

When the mode of the recorder 101 transitions to the synchronization process mode, the message processing unit 208 generates a synchronization start notification including audio data indicating the specific audio pattern unique to the terminal (recorder 101) which is recorded in the recording unit 214 (step S502). The communication unit 210 transmits the generated synchronization start notification to the recorder 102 (step S503). In other words, in step S503, the communication unit 210 transmits third information indicating the audio data recorded in the recording unit 214 to the another terminal (recorder 102). Further, in step S503, the CPU 205 causes the communication unit 210 to transmit third information indicating the audio data recorded in the recording unit 214 to the another terminal (recorder 102).

After the transmission of the synchronization start notification is completed, the CPU 205 outputs the audio data indicating the specific audio pattern unique to the terminal (recorder 101) recorded in the recording unit 214, to the signal generator 202. The signal generator 202 generates an analog audio signal based on the audio data, and outputs the generated analog audio signal to the speaker 201. The speaker 201 outputs the sound based on the analog audio signal (step S504). In other words, in step S504, the audio output module 215 outputs the sound based on the audio data recorded in the recording unit 214. Further, in step S504, the CPU 205 causes the audio output module 215 to output the sound based on the audio data recorded in the recording unit 214.

Further, the CPU 205 records time T11 at which the output of sound is started in the recording unit 214 (step S505). Subsequently, the CPU 205 starts recording by activating the A/D converter 203 and the microphone 204 so as to initialize the state (step S506). Further, the CPU 205 records time T10 at which recording is started in the recording unit 214 (step S507).

After the recording is started, sound is output from the recorder 102. The microphone 204 converts the sound which is output from the recorder 102 into an analog audio signal, and outputs the converted analog audio signal to the A/D converter 203 (step S508). The A/D converter 203 obtains the digital audio data by A/D converting the analog audio signal (step S509). In other words, in steps S508 and S509, the audio input module 216 receives the sound which is output from the another terminal (recorder 102). In addition, in steps S508 and S509, the CPU 205 causes the audio input module 216 to receive the sound which is output from the another terminal (recorder 102).

The CPU 205 records the audio data obtained in step S509 in the recording unit 214 (step S510). Subsequently, the CPU 205 sets a time required for executing a series of processes as a timeout, and determines whether or not the current time which has elapsed is a predetermined time at which a series of processes end (step S511). In this case, as the time required for executing a series of processes, for example, a 5 second time is set as the timeout. An expected completion time is a time obtained by adding the timeout to time T11 at which the output of sound is started.

When the current time has not elapsed the expected completion time, the process of step S508 is performed again. Further, when the current time elapses the expected completion time, the CPU 205 ends the recording by stopping the A/D converter 203 and the microphone 204 (step S512).

Subsequently, the audio data comparing unit 207 compares the audio data indicating the specific audio pattern unique to the terminal (recorder 101) which is recorded in the recording unit 214 with the audio data recorded in the recording unit 214 by the processes of steps S508 to S510, and determines whether or not two pieces of audio data match (step S513). In step S513, through the processes of steps S508 to S510, it is determined that two pieces of audio data match when a pattern which matches the specific audio pattern unique to the terminal (recorder 101) is included in the pattern of the audio data which is recorded in the recording unit 214, but it is determined that two pieces of audio data do not match in other cases. By performing the process of step S513, the audio data comparing unit 207 detects audio data which matches the audio data recorded in the recording unit 214, from the audio data based on the sound which is output from the another terminal (recorder 102) and is input to the audio input module 216.

When the two pieces of audio data do not match, the process ends. Further, when the two pieces of audio data match, the audio data comparing unit 207 detects time T12 at which the input of sound is started, by a method described using FIG. 4 and outputs the detected time T12 to the CPU 205. The CPU 205 records time T12 in the recording unit 214 (step S514).

Subsequently, the communication unit 210 receives the synchronization process notification transmitted from the recorder 102. The message processing unit 208 processes the synchronization process notification and outputs information regarding time T21 and time T22 included in the synchronization process notification to the CPU 205 (step S515). In other words, in step S515, the communication unit 210 receives first information indicating time T21 at which the input of the sound which is output from the audio output module 215 in step S504 is started in the another terminal (recorder 102), and second information indicating time T22 at which the output of the sound which is output from the another terminal (recorder 102) and input to the audio input module 216 is started in the another terminal (recorder 102), from the another terminal (recorder 102). Further, in step S515, CPU 205 causes the communication unit 210 to receive the first information indicating time T21 and the second information indicating time T22 from to the another terminal (recorder 102).

The CPU 205 determines whether or not the time difference is included in the synchronization process notification, based on the information from the message processing unit 208 (step S516). When the time difference is not included in the synchronization process notification, the calculation of the time difference fails and the process is ended. Further, when the time difference is included in the synchronization process notification, the time difference calculation unit 206 calculates a time difference between its own terminal (recorder 101) and the another terminal (recorder 102), based on time T11 at which output of sound from the audio output module 215 is started in step S504, time T12 at which input of sound corresponding to audio data which matches the audio data (audio data indicating a specific audio pattern unique to the recorder 101) recorded in the recording unit 214 to the audio input module 216 is started, time T21 indicated by the first information received from the another terminal (recorder 102), and time T22 indicated by the second information received from the another terminal (recorder 102) (step S517).

The time difference calculated in step S517 is recorded in the recording unit 214, and used for synthesizing the audio data. If the time difference is calculated, the process is ended.

Operation of Recorder 102 During Synchronization Process

Figure 6:
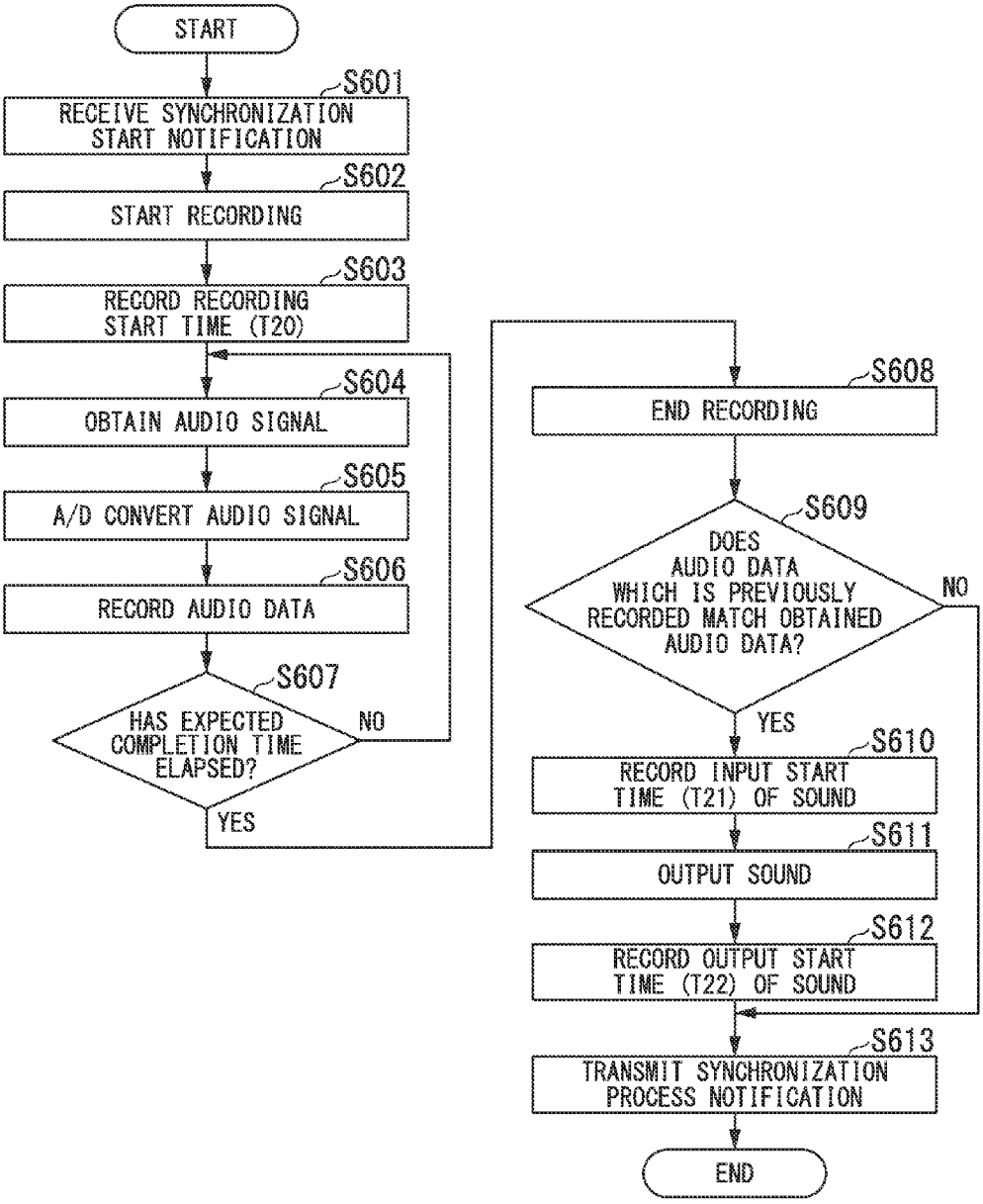
FIG. 6 is a flowchart illustrating the procedure of the operation of the recorder according to the embodiment of the present invention.

FIG. 6 shows the flow of a process performed by the recorder 102 in response to the process of obtaining a time difference performed by the recorder 101. When the process is started, the recorder 102 is in a state of being connected to the recorder 101 through the network. If the process is started, the communication unit 210 receives a synchronization start notification transmitted from the recorder 101. The message processing unit 208 processes the synchronization start notification and outputs the audio data included in the synchronization start notification to the CPU 205. The CPU 205 records the audio data in the recording unit 214 (step S601). In other words, in step S601, the communication unit 210 receives third information indicating audio data from the another terminal (recorder 101). In addition, in step S601, the CPU 205 causes the communication unit 210 to receive the third information indicating audio data from the another terminal (recorder 101).

Subsequently, the CPU 205 starts recording by activating the A/D converter 203 and the microphone 204 so as to initialize the state (step S602). Further, the CPU 205 records time T20 at which recording is started in the recording unit 214 (step S603).

After the recording is started, sound is output from the recorder 101. After the recording is started, the microphone 204 converts the sound which is output from the recorder 101 into an analog audio signal, and outputs the converted analog audio signal to the A/D converter 203 (step S604). The A/D converter 203 obtains the digital audio data by A/D converting the analog audio signal (step S605). In other words, in steps S603 and S604, the audio input module 216 receives the sound which is output from the another terminal (recorder 101). In addition, in steps S603 and S604, the CPU 205 causes the audio input module 216 to input the sound which is output from the another terminal (recorder 102).

The CPU 205 records the audio data obtained in step S605 in the recording unit 214 (step S606). Subsequently, the CPU 205 sets a time required for executing a series of processes as a timeout, and determines whether or not the current time has elapsed a predetermined time at which a series of processes end (step S607). In this case, as the time required for executing a series of processes, for example, a five second time is set as the timeout. An expected completion time is a time obtained by adding the timeout to time T11 at which the output of sound is started.

When the current time has not elapsed the expected completion time, the process of step S604 is performed again. Further, when the current time elapses the expected completion time, the CPU 205 ends the recording by stopping the A/D converter 203 and the microphone 204 (step S608).

Subsequently, the audio data comparing unit 207 compares the audio data indicating the specific audio pattern unique to the terminal (recorder 101) which is recorded in the recording unit 214 with the audio data recorded in the recording unit 214 by the processes of steps S604 to S606, and determines whether or not two pieces of audio data match (step S609). The audio data indicating the specific audio pattern unique to the terminal (recorder 101) is audio data included in the synchronization start notification received in step S601. In step S609, through the processes of steps S604 to S606, it is determined that two pieces of audio data match when a pattern which matches the specific audio pattern unique to the terminal (recorder 101) is included in the pattern of the audio data which is recorded in the recording unit 214, but it is determined that two pieces of audio data do not match in other cases. By performing the process of step S609, the audio data comparing unit 207 detects audio data which matches the audio data recorded in the recording unit 214, from the audio data based on the sound which is output from the another terminal (recorder 102) and is input to the audio input module 216.

When the two pieces of audio data do not match, the process of step S613 is performed. Further, when the two pieces of audio data match, the audio data comparing unit 207 detects time T21 at which the input of sound is started, by a method described using FIG. 4 and outputs the detected time T21 to the CPU 205. The CPU 205 records time T21 in the recording unit 214 (step S610).

Subsequently, the CPU 205 reads the audio data indicating the specific audio pattern unique to the terminal (recorder 101), which is recorded in the recording unit 214, from the recording unit 214 and outputs the audio data to the signal generator 202. The signal generator 202 generates an analog audio signal based on the audio data, and outputs the generated analog audio signal to the speaker 201. The speaker 201 outputs sound based on the analog audio signal (step S611). In other words, in step S611, the audio output module 215 outputs sound based on the audio data (audio data indicated by the third information) recorded in the recording unit 214. Further, in step S611, the CPU 205 causes the audio output module 215 to output the sound based on the audio data (audio data indicated by the third information) recorded in the recording unit 214.

Further, the CPU 205 records time T22 at which the output of sound is started, in the recording unit 214 (step S612). Subsequently, the message processing unit 208 generates a synchronization process notification including the time T21 and time T22 recorded in the recording unit 214. The communication unit 210 transmits the generated synchronization process notification to the recorder 101 (step S613). In other words, in step S613, the communication unit 210 transmits first information indicating time T21 at which the input of sound to the audio input module 216 is started, and second information indicating time T22 at which the output of sound from the audio output module 215 is started, to the another terminal (recorder 101). Further, in step S613, the CPU 205 causes the communication unit 210 to transmit the first information indicating time T21 and the second information indicating time T22, to the another terminal (recorder 101).

However, in step S609, when the two pieces of audio data do not match, in step S613, a synchronization process notification without including the time T21 and time T22 is transmitted to the recorder 101. After the synchronization process notification is transmitted, the process is ended.

Operation of Recorder 101 During Synchronous Recording Execution

Figure 7:
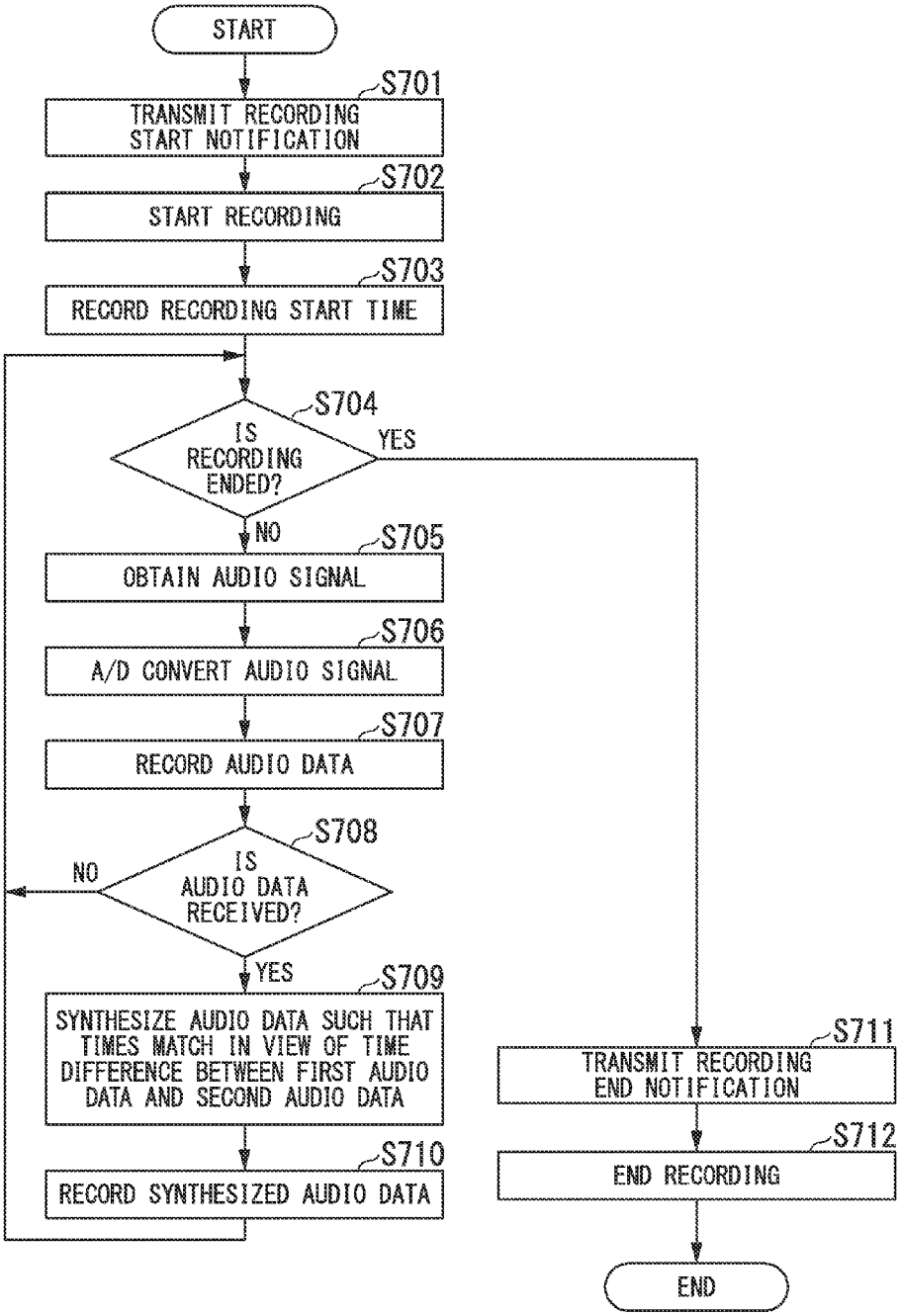
FIG. 7 is a flowchart illustrating the procedure of the operation of the recorder according to the embodiment of the present invention.

FIG. 7 shows the flow of a process performed by the recorder 101 when the recorder 101 and the recorder 102 synchronously perform a recording. When the process is started, the recorder 101 is in a state of being connected to the recorder 102 through the network. If the process is started, the operation unit 211 receives an operation of starting the recording from the user. Based on the operation, the message processing unit 208 generates a recording start notification, and the communication unit 210 transmits the generated recording start notification to the recorder 102 (step S701). In other words, in step S701, the communication unit 210 transmits information indicating the start of recording to the another terminal (recorder 102). Further, in step S701, the CPU 205 causes the communication unit 210 to transmit the information indicating the start of recording to the another terminal (recorder 102).

Subsequently, the CPU 205 starts recording by activating the A/D converter 203 and the microphone 204 so as to initialize the state (step S702). Further, the CPU 205 records the time at which recording is started in the recording unit 214 (step S703). Subsequently, the CPU 205 monitors the state of the operation unit 211, and determines whether or not the operation unit 211 receives an operation of ending the recording from the user (step S704).

When the operation unit 211 receives the operation of ending the recording from the user, the message processing unit 208 generates a recording end notification and the communication unit 210 transmits the generated recording end notification to the recorder 102 (step S7111). In other words, in step S711, the communication unit 210 transmits information indicating the end of recording to the another terminal (recorder 102). Further, in step S711, the CPU 205 causes the communication unit 210 to transmit the information indicating the end of recording to the another terminal (recorder 102).

After the recording end notification is transmitted, the CPU 205 ends the recording by stopping the A/D converter 203 and the microphone 204 (step S712). Thus, the process regarding the synchronous recording is ended.

When the operation unit 211 does not receive the operation of ending the recording from the user, the microphone 204 converts the sound which is output from the sound source S into an analog audio signal, and outputs the converted analog audio signal to the A/D converter 203 (step S705). The A/D converter 203 obtains the digital audio data by A/D converting the analog audio signal (step S706). In other words, in steps S705 and S706, the audio input module 216 receives the sound which is output from the sound source S excluding the another terminal (recorder 102). Further, in steps S705 and S706, the CPU 205 causes the audio input module 216 to receive the sound which is output from the sound source S excluding the another terminal (recorder 102).

The CPU 205 records the audio data obtained in step S706 in the recording unit 214 (step S707). In this case, time recorded in the recording unit 214 in step S703 is recorded in the audio data. Subsequently, the CPU 205 monitors the state of the communication unit 210 and determines whether or not the audio data which is transmitted from the recorder 102 is received (step S708).

When the audio data is not received, the process of step S704 is performed.

The communication unit 210 receives a message including audio data from the recorder 102. The message processing unit 208 processes the received message, and notifies the audio data included in the message to the CPU 205. In other words, the communication unit 210 receives audio data based on the sound which is output from the sound source S and input to the another terminal (recorder 102) from the another terminal (recorder 102). Further, the CPU 205 causes the communication unit 210 to receive the audio data based on the sound which is output from the sound source S and input to the another terminal (recorder 102) from the another terminal (recorder 102). In this case, it is determined in step S708 that audio data is received.

When the audio data is received, the data synthesis unit 213 adjusts the time difference (relative time of the recorder 101 and the recorder 102) between the audio data received from the recorder 102 and the audio data based on the sound which is output from the sound source S and input to the audio input module 216, based on the time difference calculated by the time difference calculation unit 206. In this case, the time of any one or both of two pieces of audio data is adjusted such that the times of respective pieces of audio data match. Further, the data synthesis unit 213 synthesizes the respective pieces of audio data (step S709). The data synthesis unit 213 records the synthesized audio data in the recording unit 214 (step S710). Subsequently, the process of step S704 is performed.

Operation of Recorder 102 During Synchronous Recording Execution

Figure 8:
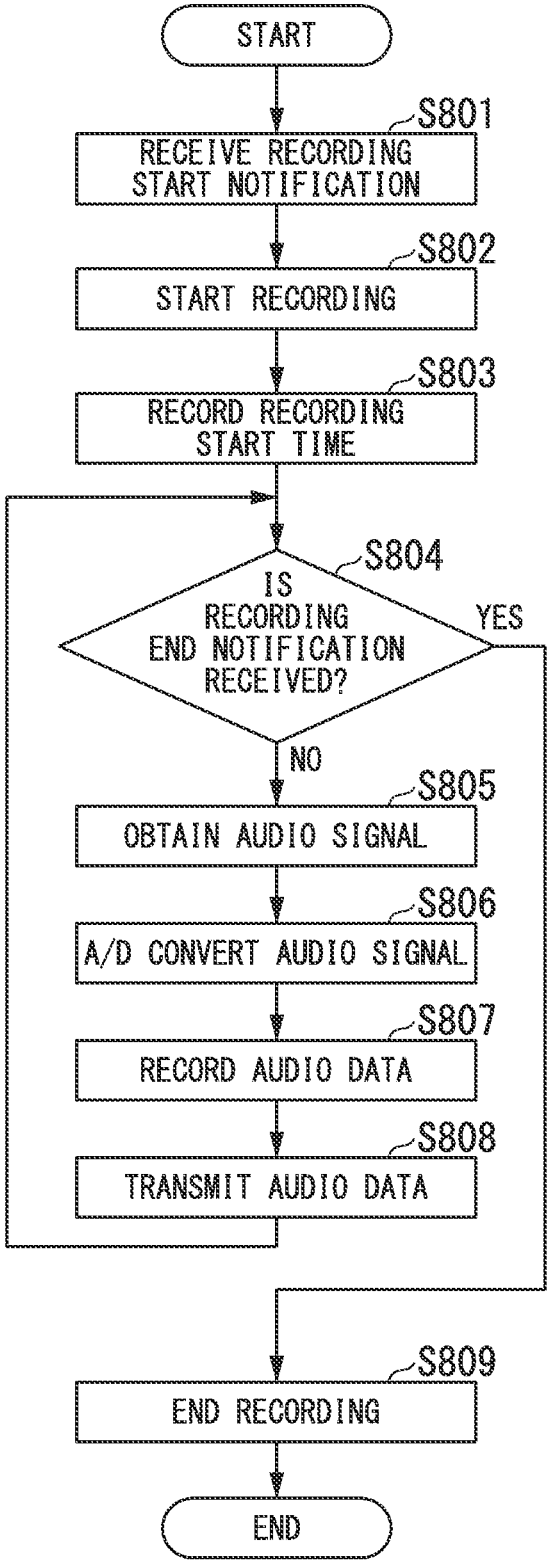
FIG. 8 is a flowchart illustrating the procedure of the operation of the recorder according to the embodiment of the present invention.

FIG. 8 shows the flow of a process performed by the recorder 102 when the recorder 101 and the recorder 102 synchronously perform a recording. When the process is started, the recorder 102 is in a state of being connected to the recorder 101 through the network. If the process is started, the communication unit 210 receives a recording start notification transmitted from the recorder 101. The message processing unit 208 processes the recording start notification and notifies the start of recording to the CPU 205 (step S801). In other words, in step S801, the communication unit 210 receives information indicating the start of recording from the another terminal (recorder 101). Further, in step S801, the CPU 205 causes the communication unit 210 to receive the information indicating the start of recording from the another terminal (recorder 101).

Subsequently, the CPU 205 starts recording by activating the A/D converter 203 and the microphone 204 so as to initialize the state (step S802). Further, the CPU 205 records the time at which recording is started in the recording unit 214 (step S803).

Subsequently, the CPU 205 monitors the state of the communication unit 210 and determines whether or not the recording end notification which is transmitted from the recorder 101 is received (step S804). When the recording end notification is received, the CPU 205 ends recording by stopping the A/D converter 203 and the microphone 204 (step S809). Thus, the process regarding the synchronous recording is ended.

When the recording end notification is not received, the microphone 204 converts the sound which is output from the sound source S into an analog audio signal, and outputs the converted analog audio signal to the A/D converter 203 (step S805). The A/D converter 203 obtains the digital audio data by A/D converting the analog audio signal (step S806). In other words, in steps S805 and S806, the audio input module 216 receives the sound which is output from the sound source S excluding the another terminal (recorder 101). Further, in steps S805 and S806, the CPU 205 causes the audio input module 216 to receive the sound which is output from the sound source S excluding the another terminal (recorder 101).

The CPU 205 records the audio data obtained in step S806 in the recording unit 214 (step S807). In this case, the time, which is recorded in the recording unit 214 in step S803, is recorded in the audio data.

Subsequently, the message processing unit 208 generates a message including the audio data that is recorded in the recording unit 214 in step S807, and the communication unit 210 transmits the generated message to the another terminal (recorder 101) (step S808). In other words, in step S808, the communication unit 210 transmits audio data based on the sound which is output from the sound source S and is input to the audio input module 216, to the another terminal (recorder 101). Further, in step S808, the CPU 205 causes the communication unit 210 to transmit the audio data based on the sound which is output from the sound source S and is input to the audio input module 216, to the another terminal (recorder 101). Subsequently, the process of step S804 is performed.

Through the process described above, it is possible to obtain audio data by synchronous recording of the recorder 101 and the recorder 102.

Audio Data

Figure 9:
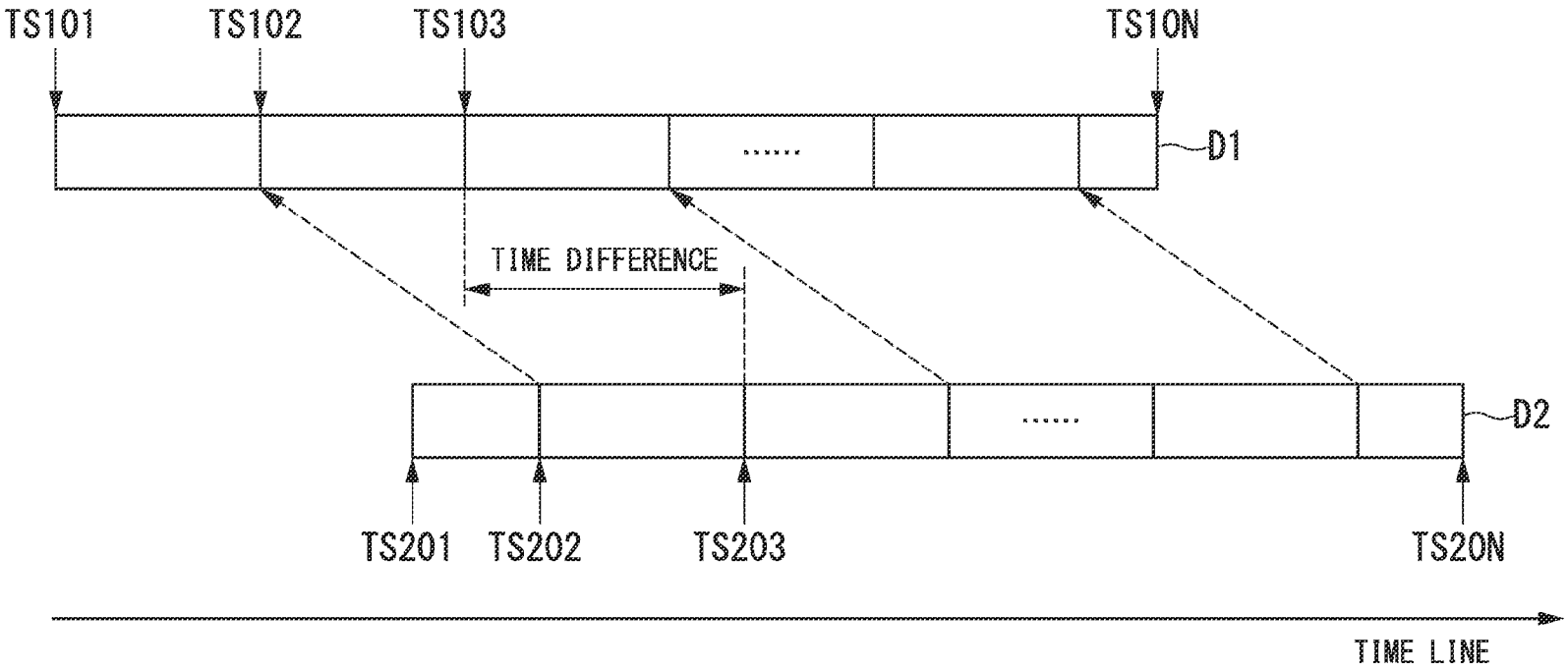
FIG. 9 is a timing chart of audio data in the embodiment of the present invention.

FIG. 9 is an example of a time chart of audio data. The horizontal direction of FIG. 9 represents a time line. The audio data D1 is audio data recorded in the recorder 101, and the audio data D2 is audio data recorded in the recorder 102. A time (recording start time) to be recorded in the audio data D1 at a time of recording start is time TS101, and a time (recording start time) to be recorded in the audio data D2 at a time of recording start is time TS102. Due to a difference in the internal times of the recorder 101 and recorder 102 and an influence of the arrival time of the recording start notification and an internal processing time, as shown in FIG. 9, the audio data D1 and the audio data D2 are not synchronized on the time line.

The times on the time line of the audio data D1 are assumed to be TS102, TS103, . . . , and TS10N, and the times on the time line of the audio data D2 are assumed to be TS202, TS203, . . . , and TS20N. The respective times can be calculated from the recording start time TS101 and time TS201. For example, if the time TS102 and the time TS103 are respectively 10 seconds of elapsed time and 20 seconds of elapsed time from the recording start, the respective times are TS101+10 and TS102+20. In the same manner, it is possible to calculate time TS202 and time TS203 with respect to the audio data D2.

Time TS103 and time TS203 are separated by the time difference. In the same manner, time TS102 and time TS202 are separated by the time difference. Accordingly, synthesized data can be obtained by relatively shifting the audio data D1 and the audio data D2 by the time difference to match the timings.

Figure 10:
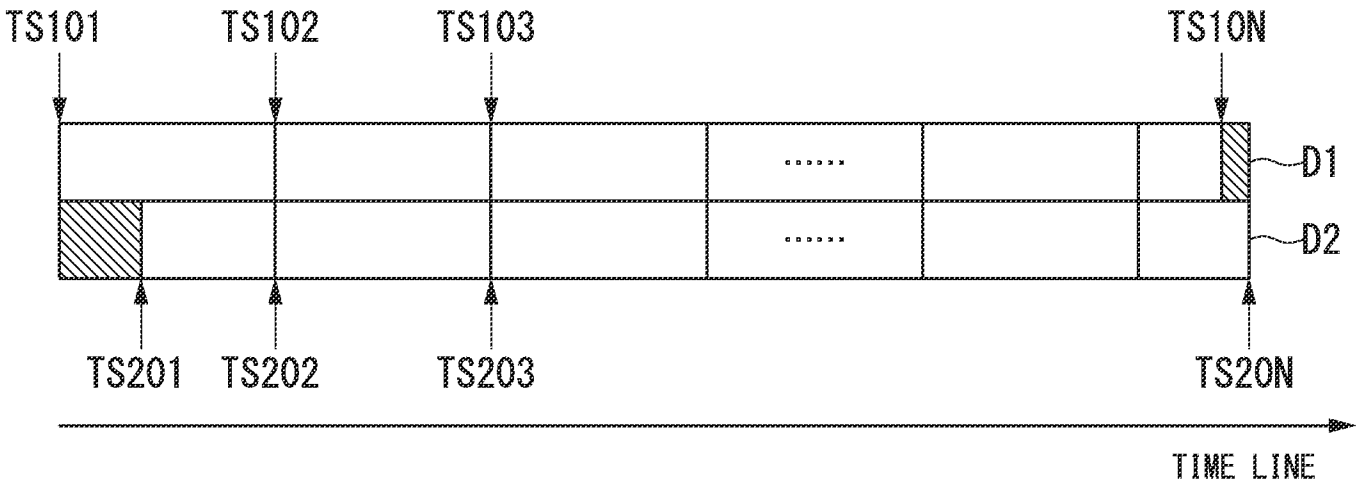
FIG. 10 is a timing chart of audio data in the embodiment of the present invention.

FIG. 10 shows audio data for which time is adjusted. The time TS102 and time TS103 on the timeline of audio data D1 match the time TS202 and time TS203 on the time line of audio data D2. The timings of recording start and recording end cannot be fully synchronized in the recorder 101 and the recorder 102. For this reason, some difference may occur in the audio data length. For example, as shown in FIG. 10, the recording start time TS101 of the audio data D1 and the recording start time TS201 of the audio data D2 deviate from each other. Further, the recording end time TS10N of the audio data D1 and the recording end time TS20N of the audio data D2 deviate from each other. In FIG. 10, a portion without data corresponding to the audio data having a longer data length is filled with silent data (hatched portion of FIG. 10) in order to match the data lengths of the two pieces of audio data. Alternatively, the end portion of the audio data having a longer data length may be truncated in order to match a data length to audio data having a shorter data length.

According to the present embodiment, an audio data synthesis terminal (recorder 101) is configured which includes a recording module (recording unit 214) that records audio data including first audio data; an audio output module 215 that outputs audio based on the audio data which is recorded in the recording module; an audio input module 216 that receives sound which is output from the another terminal (recorder 102) and sound which is output from a sound source S excluding the another terminal, an audio detection unit (audio data comparing unit 207) that detects audio data which matches the first audio data, from audio data based on the sound which is output from the another terminal and input to the audio input module 216; a wireless communication module (communication unit 210) that receives first information indicating time T21 at which input of the audio which is output from the audio output module 215 is started in the another terminal, and second information indicating time T22 at which the output of the sound which is output from the another terminal and input to the audio input module 216 is started in the another terminal, from the another terminal, and receives second audio data based on the sound which is output from the sound source S and input to the another terminal, from the another terminal; a time difference calculation unit 206 that calculates a time difference between its own terminal (recorder 101) and the another terminal, based on time T11 at which output of sound from the audio output module 215 is started, time T12 at which input of sound corresponding to audio data which matches first audio data to the audio input module 216 is started, time T21 indicated by the first information, and time T22 indicated by the second information; and a data synthesis unit 213 that synthesizes the second audio data and third audio data after a time difference between the second audio data and the third audio data based on the sound which is output from the sound source S and is input to the audio input module 216 is adjusted, based on the time difference calculated by the time difference calculation unit 206.

Further, according to the present embodiment, an audio data recording terminal (recorder 102) includes a recording module (recording unit 214) that records audio data including first audio data; an audio output module 215 that outputs sound based on the audio data which is recorded in the recording module; an audio input module 216 that receives sound which is output from the another terminal (recorder 101) and sound which is output from a sound source S excluding the another terminal; an audio detection unit (audio data comparing unit 207) that detects audio data which matches the first audio data, from audio data based on the sound which is output from the another terminal and input to the audio input module 216; a control unit (CPU 205) that controls sound based on the audio data which is recorded in the recording module to output from the audio output module 215, when the audio data which matches the first audio data is detected; and a wireless communication module (communication unit 210) that transmits first information indicating time T21 at which input of the sound which is output from the another terminal is started in the audio input module 216, and second information indicating time T22 at which output of sound is started from the audio output module 215, to the another terminal, and transmits second audio data based on the sound which is output from the sound source S and input to the audio input module 216, to the another terminal.

Further, according to the present embodiment, an audio data synthesis system including an audio data synthesis terminal (recorder 101) and an audio data recording terminal (recorder 102) is configured, in which the audio data synthesis terminal includes a first recording module (recording unit 214) that records audio data including first audio data; a first audio output module 215 that outputs sound based on the audio data which is recorded in the first recording module; a first audio input module 216 that receives sound which is output from the audio data recording terminal and sound which is output from a sound source S excluding the audio data recording terminal: a first audio detection unit (audio data comparing unit 207) that detects audio data which matches the first audio data, from audio data based on the sound which is output from the audio data recording terminal and input to the first audio input module 216; a first wireless communication module (communication unit 210) that receives first information indicating time T21 at which input of the sound which is output from the first audio output module 215 is started in the audio data recording terminal, and second information indicating time T22 at which the output of the sound which is output from the audio data recording terminal and input to the first audio input module 216 is started in the audio data recording terminal, from the audio data recording terminal, and receives second audio data based on the sound which is output from the sound source S and input to the audio data recording terminal, from the audio data recording terminal; a time difference calculation unit 206 that calculates a time difference between the audio data synthesis terminal and the audio data recording terminal, based on time T11 at which output of sound from the first audio output module 215 is started, time T12 at which input of sound corresponding to audio data which matches the first audio data to the first audio input module 216 is started, time T21 indicated by the first information, and time T22 indicated by the second information; and a data synthesis unit 213 that synthesizes the second audio data and third audio data after a time difference between the second audio data and the third audio data based on the sound which is output from the sound source S and is input to the first audio input module 216 is adjusted, based on the time difference calculated by the time difference calculation unit 206.

Further, the audio data recording terminal in the audio data synthesis system according to the present embodiment includes a second recording module (recording unit 214) that records audio data including fourth audio data; a second audio output module 215 that outputs sound (fourth sound) based on the audio data which is recorded in the second recording module; a second audio input module 216 that inputs sound (fifth sound) which is output from the audio data synthesis terminal and sound (sixth sound) which is output from the sound source; a second audio detection unit (audio data comparing unit 207) that detects audio data which matches the fourth audio data, from audio data based on the sound which is output from the audio data synthesis terminal and input to the second audio input module 216; a control unit (CPU 205) that controls sound based on the audio data which is recorded in the second recording module to output from the second audio output module 215, when audio data which matches the fourth audio data is detected; and a second wireless communication module (communication unit 210) that transmits first information indicating time T21 at which input of the sound which is output from the audio data synthesis terminal is started in the second audio input module 216, and second information indicating time T22 at which output of sound is started from the second audio output module 215 to the audio data synthesis terminal, and transmits the second audio data based on the sound which is output from the sound source S and input to the second audio input module 216, to the audio data synthesis terminal.

Furthermore, according to the present embodiment, an audio data synthesis method is configured which includes a step S504 of an audio output module 215 outputting sound based on the audio data which is recorded in a recording module (recording unit 214) that records audio data including first audio data; steps S508 and S509 of an audio input module 216 inputting sound which is output from the another terminal (recorder 102); a step S513 of an audio detection unit (audio data comparing unit 207) detecting audio data which matches the first audio data, from audio data based on the sound which is output from the another terminal and input to the audio input module 216; a step S515 of a wireless communication module (communication unit 210) receiving first information indicating time T21 at which input of the sound which is output from the audio output module 215 is started in the another terminal, and second information indicating time T22 at which the output of the sound which is output from the another terminal and input to the audio input module 216 is started in the another terminal, from the another terminal; a step S517 of a time difference calculation unit 206 calculating a time difference between its own terminal (recorder 101) and the another terminal, based on time T11 at which output of sound from the audio output module 215 is started, time T12 at which input of sound corresponding to audio data which matches the first audio data to the audio input module 216 is started, time T21 indicated by the first information, and time T22 indicated by the second information; steps S705 and S706 of the audio input module 216 inputting sound which is output from a sound source S excluding the another terminal; a step S708 of the wireless communication module receiving second audio data based on the sound which is output from the sound source S and input to the another terminal, from the another terminal; and a step S709 of a data synthesis unit 213 synthesizing the second audio data and third audio data after a time difference between the second audio data and third audio data based on the sound which is output from the sound source S and is input to the audio input module 216 is adjusted, based on the calculated time difference.

Further, according to the present embodiment, an audio output method is configured which includes steps S604 and S605 of an audio input module 216 inputting sound which is output from the another terminal (recorder 101); a step S609 of an audio detection unit (audio data comparing unit 207) detecting audio data which matches first audio data recorded in a recording module (recording unit 214) which records audio data including first audio data, from audio data based on the sound which is output from the another terminal and input to the audio input module 216; a step S611 of an audio output module 215 outputting sound based on the audio data recorded in the recording module when the audio data which matches the first audio data is detected; a step S613 of the wireless communication module (communication unit 210) transmitting first information indicating time T21 at which input of the sound which is output from the another terminal is started in the audio input module 216, and second information indicating time T22 at which output of sound from the audio output module 215 is started, to the another terminal; steps S805 and S806 of the audio input module 216 inputting sound which is output from the sound source S excluding the another terminal; a step S808 of the wireless communication module transmitting second audio data based on the sound which is output from the sound source S and input to the audio input module 216, to the another terminal.

Further, according to the present embodiment, a program is configured which causes a computer to perform: a step S504 of an audio output module 215 outputting sound based on the audio data which is recorded in a recording module (recording unit 214) that records audio data including first audio data; steps S508 and S509 of an audio input module 216 inputting sound which is output from the another terminal (recorder 102); a step S513 of detecting audio data which matches the first audio data, from audio data based on the sound which is output from the another terminal and input to the audio input module 216; a step S515 of a wireless communication module (communication unit 210) receiving first information indicating time T21 at which input of the sound which is output from the audio output module 215 is started in the another terminal, and second information indicating time T22 at which the output of the sound which is output from the another terminal and input to the audio input module 216 is started in the another terminal, from the another terminal; a step S517 of calculating a time difference between its own terminal (recorder 101) and the another terminal, based on time TL 1 at which output of sound from the audio output module 215 is started, time T 12 at which input of sound corresponding to audio data which matches the first audio data to the audio input module 216 is started, time T21 indicated by the first information, and time T22 indicated by the second information; steps S705 and S706 of the audio input module 216 inputting sound which is output from a sound source S excluding the another terminal; a step S708 of the wireless communication module (communication unit 210) receiving second audio data based on the sound which is output from the sound source S and input to the another terminal, from the another terminal; and a step S709 of synthesizing the second audio data and third audio data after a time difference between the second audio data and third audio data based on the sound which is output from the sound source S and is input to the audio input module 216 is adjusted, based on the calculated time difference.

Further, according to the present embodiment, a program is configured which causes a computer to perform: steps S604 and S605 of an audio input module 216 inputting sound which is output from the another terminal (recorder 101); a step S609 of detecting audio data which matches first audio data recorded in a recording module (recording unit 214) which records audio data including first audio data, from audio data based on the sound which is output from the another terminal and input to the audio input module 216; a step S611 of outputting sound to the audio output module 215 based on the audio data recorded in the recording module when the audio data which matches the first audio data is detected; a step S613 of the wireless communication module (communication unit 210) transmitting first information indicating time T21 at which input of the sound which is output from the another terminal is started in the audio input module 216, and second information indicating time T22 at which output of sound from the audio output module 215 is started, to the another terminal; steps S805 and S806 of the audio input module 216 inputting sound which is output from the sound source S excluding the another terminal; and a step S808 of the wireless communication module transmitting second audio data based on the sound which is output from the sound source S and input to the audio input module 216, to the another terminal.

In the present embodiment, a time difference between terminals is calculated, and a time difference between audio data to be synthesized is adjusted based on the calculated time difference. Thus, it is possible to adjust the times of a plurality of pieces of audio data, without using an apparatus capable of acquiring a reference time. Further, it is possible to simply perform multi-channel recording between terminals, connected through a wireless network, in which times are not synchronized.

Further, in the synchronization process, the respective terminals commonly use the first audio data (audio data indicating the specific audio pattern unique to the recorder 101) so as to perform the input and output of sound (steps S302 and S303), and thus the storage amount of the audio data which is stored by the respective terminals for the synchronization process can be reduced. Further, in the synchronization process, audio data indicating the specific audio pattern unique to the terminal (recorder 101) which performs the synchronization process is used, and thus even if a terminal which does not perform the synchronous recording is present in the vicinity of a terminal which performs the synchronous recording, the synchronization process can be performed without being affected by the terminal which does not perform the synchronous recording.

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An audio data synthesis method comprising steps of:

recording a recorded audio data including a first audio data;

outputting a first sound based on the recorded audio data;

inputting a second sound that is output from another terminal and a third sound that is output from a sound source excluding the another terminal is input;

detecting an audio data which matches the first audio data, from an input audio data based on the second sound which is input to the audio input nodule;

receiving first information indicating a time at which input of the first sound is started in the another terminal and second information indicating a time at which output of the second sound is started in the another terminal, and receiving a second audio data based on a sound which is output from the sound source and input to the another terminal, from the another terminal;

calculating a time difference between own terminal and the another terminal, based on the time at which output of the first sound from the audio output module is started, a time at which input of a sound corresponding to the audio data to the audio input module is started, a time indicated by the first information, and a time indicated by the second information; and synthesizing the second audio data and third audio data after a time difference between the second audio data and the third audio data based on the third sound which is input to the audio input module is adjusted, based on the time difference.

2. The audio data synthesis method according to claim 1, wherein the outputting the first sound step outputs the first sound based on the first audio data.

3. The audio data synthesis method according to claim 2, wherein the receiving step further transmits third information indicating the first audio data to the another terminal.

4. An audio data recording method comprising steps of:

recording a recorded audio data including a first audio data;

outputting a first sound based on the recorded audio data;

inputting a second sound that is output from another terminal and a third sound that is output from a sound source excluding the another terminal is input;

detecting an audio data which matches the first audio data, from an input audio data based on the second sound;

causing the first sound based on the recorded audio data to output from the audio output module, when the audio data is detected; and transmitting first information indicating a time at which input of the second sound is started in the audio input module, and second information indicating a time at which output of the first sound is started from the audio output module, to the another terminal, and transmits a second audio data based on the third sound which is output from the sound source and input to the audio input module, to the another terminal.

5. The audio data recording method according to claim 4, wherein the outputting a first sound step outputs the first sound based on the first audio data.

6. The audio data recording method according to claim 5, wherein the transmitting first information step further receives third information indicating the first audio data from the another terminal, and wherein the outputting the first sound step outputs a sound based on the first audio data indicated by the third information.

7. A non-transitory computer-readable device storing a program that causes a computer to perform the steps of:

causing an audio input module to input a first sound which is output from another terminal;

causing an audio detection unit to detect an audio data which matches a first audio data recorded in a recording module that records a recorded audio data including the first audio data, from an input audio data based on the first sound which is input to the audio input module;

causing an audio output module to output a second sound based on the recorded audio data when the audio data is detected;

causing a wireless communication module to transmit first information indicating a time at which input of the first sound is started in the audio input module, and second information indicating a time at which output of the second sound from the audio output module is started, to the another terminal;

causing the audio input module to input a third sound which is output from a sound source excluding the another terminal; and causing the wireless communication module to transmit a second audio data based on the third sound which is input to the audio input module, to the another terminal.

8. A non-transitory computer-readable device storing a program that causes a computer to perform the steps of:

causing an audio output module to output a first sound based on a recorded audio data which is recorded in a recording module that records the recorded audio data including first audio data;

causing an audio input module to input a second sound which is output from another terminal;

causing an audio detection unit to detect an audio data which matches the first audio data, from an input audio data based on the second sound which is input to the audio input module;

causing a wireless communication module to receive first information indicating a time at which input of the first sound is started in the another terminal, and second information indicating a time at which output of the second sound is started in the another terminal;

causing a time difference calculation unit to calculate a time difference between own terminal and the another terminal, based on a time at which output of the first sound from the audio output module is started, a time at which input of a sound corresponding to the audio data to the audio input module is started, a time indicated by the first information, and a time indicated by the second information;

causing the audio input module to input a third sound which is output from a sound source excluding the another terminal;

causing the wireless communication module to receive second audio data based on the third sound which is input to the another terminal, from the another terminal; and causing a data synthesis unit to synthesize the second audio data and third audio data, after a time difference between the second audio data and the third audio data based on the third sound which is input to the audio input module is adjusted, based on the calculated time difference.

* * * * *